US005303949A

United States Patent [19]

Harper et al.

[11] Patent Number: 5,303,949

[45] Date of Patent: Apr. 19, 1994

[54] MULTI-EDGED DOWNHILL SNOW SKIS

[76] Inventors: Luke J. Harper; Melvin L. Harper, both of 5345 Chambrey Ct., Colorado Springs, Colo. 80919

[21] Appl. No.: 51,869

[22] Filed: Apr. 26, 1993

[51] Int. Cl.[5] ..... A63C 5/04

[52] U.S. Cl. ..... 280/608; 280/609

[58] Field of Search ..... 280/601, 607, 608, 609, 280/610, 11.18

[56] References Cited

U.S. PATENT DOCUMENTS

| | | | |
|---|---|---|---|
| 3,871,671 | 3/1975 | Bildner | 280/11.13 E |
| 4,377,297 | 3/1983 | Staufer | 280/609 |
| 4,700,967 | 10/1987 | Meatto et al. | 280/609 |
| 4,895,388 | 1/1990 | Richmond | 280/609 |
| 5,083,810 | 1/1992 | Minidis | 280/608 |

FOREIGN PATENT DOCUMENTS

| | | | |
|---|---|---|---|
| 494087 | 3/1954 | Italy | 280/609 |
| 174689 | 1/1935 | Switzerland | 280/11.18 |
| 351882 | 3/1961 | Switzerland | 280/609 |

*Primary Examiner*—Richard M. Camby

[57] ABSTRACT

This invention provides a pair of downhill snow skis having deep side cuts which allow greater maneuverability and safety, particularly on steep slopes. Each ski is provided with two cutting edges on each side, as contrasted to one on each side in ordinary skis. The lower edge, on the bottom of the ski, is active when the angle between the ski and the slope ranges from near zero up to 52 degrees; the upper edge, near the top of the ski, is active at angles greater than 52 degrees. These edges provide ability to execute true carved turns of about one-tenth to one quarter the radii of turns executed by ordinary skis (about 20 to 45 feet as compared to about 200 feet).

5 Claims, 2 Drawing Sheets

MULTI-EDGED DOWNHILL SNOW SKIS

FIELD OF THE INVENTION

The present invention relates to a downhill snow ski having two cutting edges on each side with deep side cuts for greater maneuverability.

BACKGROUND OF THE INVENTION

The natural carved turn radius of a ski is determined by the relation between its length and side cut, and the angle theta formed between the ski and the slope during turns. The turn radius is not constant for a given ski, but decreases with increasing theta angle. Mathematically, the nominal turning radius of a ski is defined by the following equation (from "Skiing Mechanics" by John Howe, 1983, p. 102): $r=(L^2 \text{ Cos theta})/8 \text{ sc}$, where r is the natural carved turn radius of the ski, L is the length of the ski, sc is the side cut of the ski, and theta is as defined above. The natural turning radius of skis is ordinarily 150 to over 200 feet. A much shorter turning radius is desirable, particularly on steep slopes, because this is the dominant factor in control of speed and balance. The long turning radius of conventional skis leads to unacceptably high speeds during turns, even on moderate slopes. Only expert skiers on especially designed slopes can make true carved turns; most skiers maintain only imperfect control as a result of these long turning radii. In addition to the danger to themselves and others resulting from this instability, they must side-slip the back of their skis to shorten the turn and thereby reduce speed to maintain control. Side-slipping results in effective loss of a significant portion of the ski edges with resulting loss of supporting "platform". Side-slipping requires unweighting of the skis, a maneuver many skiers never adequately learn and which in any case requires much energy. On steeper slopes, this side-slipping results in the formation of moguls.

Another advantage of a short turning radius is that lower speeds are possible without dropping below the speed necessary to overcome critical angle effects encountered at the beginning of turns. The critical angle is defined as that angle of traverse below which the skier is unstable when gravitational forces in the plane of the slope equal or exceed the centrifugal force generated by a turn. Since centrifugal force varies directly with the square of the velocity and inversely with the radius of the turn, skis with shorter turning radii generate much greater centrifugal force at a given velocity. For example, skis with a natural turning radius of 45 feet require a velocity of only 15 MPH to maintain stability on a slope of 20 degrees at the beginning of a turn, as compared to 30 MPH on skis with a turning radius of 190 feet (these figures are derived from equation 10-2, page 121 of the reference cited above).

Snowboards, being shorter than skis, and wider (which allows for side cuts on the order of 0.8 inch or more), have natural carved turn radii on the order of 30 to 40 feet. Conventional skis, by contrast, are constrained by their current design to side cuts on the order of only 0.3 inch.

SUMMARY OF THE INVENTION

The present invention is designed to overcome this limitation in depth of side cut. It comprises two new features: an edge having a deep side cut on the bottom of the ski, and an edge near the top of the ski. The lower or bottom edge is similar to that on current skis except for the deeper side cut. The edge on the top of the ski is designed to engage the slope at high theta angles and it becomes the active cutting edge at these angles. In the particular embodiment of the invention depicted herein, the effective ski length is 61.5 inches, and the side cuts of the bottom and top edges are 0.92 and 0.23 inch, respectively. When the maximum thickness of the ski is about one inch, one of the bottom edges is in contact with the slope at all theta angles less than about 52 degrees, and one of the top edges takes over as the active cutting edge at theta angles greater than about 52 degrees. The turning radius is 43 feet at low theta angles, decreasing to 26 feet at 52 degrees, and to 20 feet at 74 degrees. The rate of change in turning radius decreases after the top edges come into contact with the slope above 52 degrees, because of the smaller side cut of these edges.

This particular set of values is given only as an example. Other combinations of length and side cut will be more appropriate for other purposes. With this invention, greater scope is given for design of skis for specific conditions, such as for use on steep, narrow slopes, forested slopes where sharp turns and low speeds are required, or those slopes which are challenges for beginner or intermediate skiers. The design can also accommodate asymmetric side cuts. This would be a useful feature because many skiers find it easier to turn in one direction than the other. Scope is also allowed in this ski design to vary the type of curve built into the ski. A hyperbolic curve, for example, would result in a shorter turn radius on steeper slopes because the angle between the ski and the slope (theta) is ordinarily greater there than on less steep slopes. High theta angles result in greater effect of the central part of the curved edge, where hyperbolic curves have the greatest curvature. Steep slopes are, of course, where lower speeds associated with shorter turning radii are particularly needed. This variable turn radius would be of great benefit to all skiers, regardless of skill level. Currently, such application of complex curves is generally restricted to snowboards.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
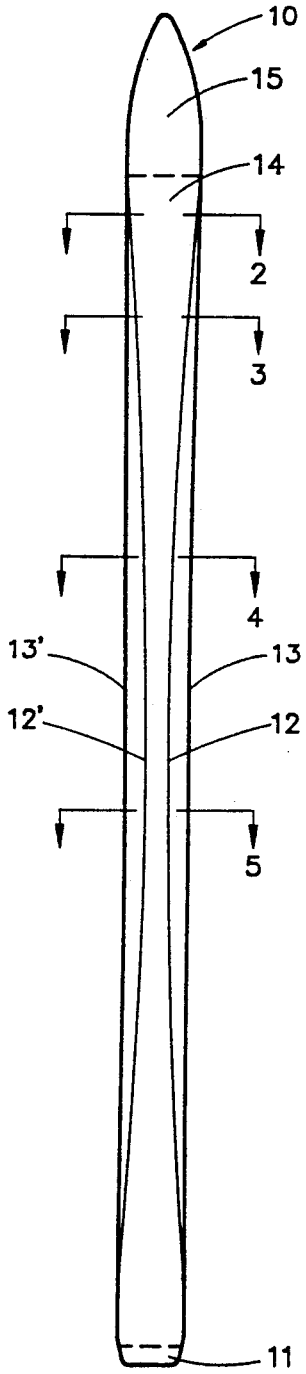
FIG. 1 is a plan view of the bottom of the ski.
Figure 2:
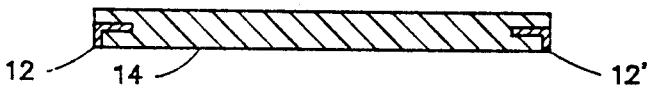
FIG. 2 is a cross-section of the ski drawn to scale, taken along line 2 of FIG. 1.

FIG. 1, a bottom view of one of a pair of identical skis, 10, incorporates the principles of the present invention. As in conventional skis, this ski has a shovel 15 at the front end, a heel 11 at the tail, and between the two the running surface 14. Unlike conventional skis, this invention provides for two edges on each side: edges 12 and 12' on the bottom of the ski bounding the running surface 14, and edges 13 and 13' near the top of the skis.

The relations between the top and bottom edges along a length of the ski are shown more clearly on FIGS. 2, 3, 4, and 5 which are cross-sections through the ski at the positions shown on FIG. 1. These sections begin near the shovel of the ski at FIG. 2 and extend progressively toward the area of the bindings at FIG. 5. It should be noted that cross-sections taken between the bindings and the heel of the ski would be similar in progression to FIGS. 5, 4, 3, and 2.

Figure 5:
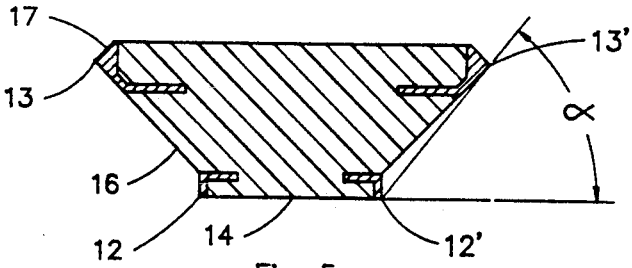
FIG. 5 is a cross-section drawn to scale, taken along line 5 of FIG. 1.
Figure 6:
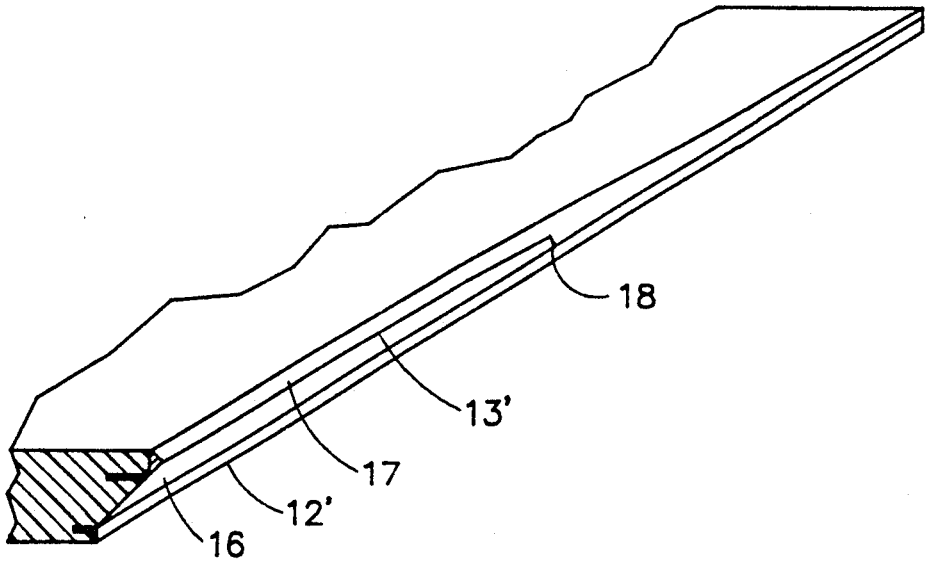
FIG. 6 is a schematic perspective side view of the ski near the shovel.

Turning now to FIG. 5, edges 12 and 12' are shown on the bottom of the ski, and edges 13 and 13' at the top of the ski. Said edges 13 and 13' are formed into a 90 degree angle between surfaces 16 and 17, FIG. 5. The 90 degree angle insures greater grip or bite of the top edges. Surface 16 is depicted in the drawings as a planar surface; however, if an even sharper top edge is desired, this surface could be formed into a concave arch. As in ordinary skis, bottom edges 12 and 12' extend the entire length of the ski, whereas top edges 13 and 13' merge with the bottom edges near the front of running surface 14 between the cross-sections shown in FIGS. 2 and 3. Similarly, the two sets of edges merge near the heel of the ski. In the portions of the ski where the two edges merge, side wall 16 decreases to zero, as indicated in FIG. 6 which is a schematic view of the edges near the front of the ski. Here, edges 12 and 12' are directly below edges 13 and 13'. At points approximately 8 inches from the front of the running surface and 4 inches from the rear of the running surface, edges 13 and 13' will be arbitrarily ended as they become too narrow to grip the snow. The point of termination of edge 13' near the front of the skis is at 18, FIG. 6.

Figure 3:
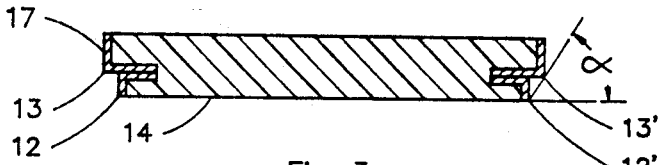
FIG. 3 is a cross-section drawn to scale, taken along line 3 of FIG. 1.
Figure 4:
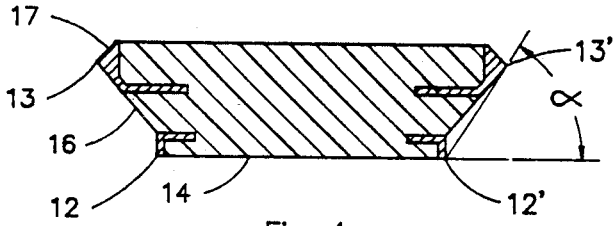
FIG. 4 is a cross section drawn to scale, taken along line 4 of FIG. 1.
Figure 7:
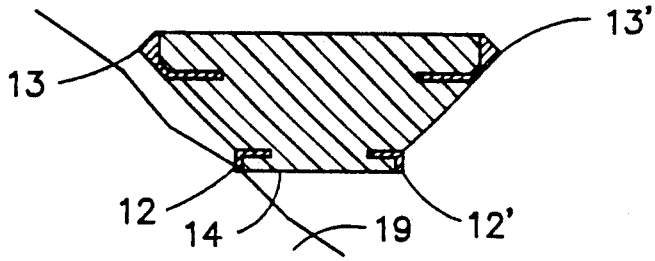
FIG. 7 is a sectional view of the ski intersecting the slope.
Figure 8:
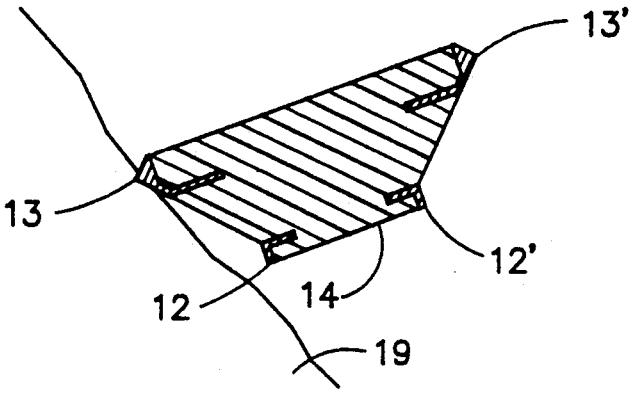
FIG. 8 is a sectional view of the ski intersecting the slope.

Angle alpha, which is formed between a line drawn in the vertical plane tangentially to edges 12' and 13' on FIGS. 3, 4, and 5, and a line drawn in the same plane parallel to the running surface, is approximately 52 degrees in this particular embodiment. Therefore, as shown in FIG. 7, where this ski is executing a turn or traverse during which the angle between the slope 19 and the running surface 14 is less than 52 degrees, edge 12 or 12' will be the "active" edge. At angles greater than this, edge 13 or 13' will be the active edge, as shown in FIG. 8. Angle alpha is built into the ski at a constant value because if it should change abruptly at any point along the ski, there would be an abrupt change in the turning radius when the ski is banked or angulated from a bottom edge to a top edge.

Referring again to FIGS. 2, 3, 4, and 5, it can be seen that the bottom running surface 14 is bounded by the steel edges 12 and 12', and that in this particular embodiment, said running surface varies in width from 1.2 inches in FIG. 5 near the bindings of the ski to 2.8 inches in FIG. 2 near the front of the ski. The area of the running surface is about 23 percent less than that of a conventional ski of similar size, assuming no penetration into the snow. The area of the running surface approaches that of conventional skis when penetration approaches one inch. During turns and traverses, the ski contact with the slope is restricted to the cutting edge and, depending on the hardness of the snow, a small area of the running surface of the ski adjacent to the edge. Therefore, there is no difference in area of contact between the ski exemplified in this invention and ordinary skis during turns or traverses on ordinary groomed slopes with moderately hard snow.

The ski 10 of FIG. 1 is about one inch in maximum thickness in the embodiment depicted herein, as compared to about 0.8 inch in ordinary skis of this length. This added thickness may be required to ensure adequate stiffness, since the deep side cuts reduce the volume of material forming the ski. If even greater stiffness (or a thinner ski) is desired, a thin plate of aluminum can be interlaminated with the top epoxy resin and fiberglass reinforced structural layer usually applied to the top of a ski. This would also insure adequate seating of the outer binding screws. The aluminum plate could be an integral part of the top edges; since more rarely used than the bottom edges, these could be made of softer metal.

While the invention has been described with respect to a single preferred embodiment, it is understood by those skilled in the art that the invention is not limited to such design. This and other variations of the invention, particularly in depth of side cut, will be apparent to those skilled in the art, and the present invention is to be limited only by the following claims.

What is claimed is:

1. A downhill snow ski, one of an identical pair, having a shovel section separated from a heel section by a waist section extending along a longitudinal axis, on the top of which waist section boot bindings can be mounted, said waist section comprising:

(a) a bottom surface and a top surface;

(b) a first side and a second side;

(c) a first surface on each side extending vertically upward from the bottom surface, forming a first cutting edge along each intersection of said bottom surface and each first surface, said first cutting edges having first side cuts;

(d) a second surface on each side extending from the first surface on that side;

(e) a third surface on each side extending from the second surface on that side, forming a second cutting edge along each intersection of each second surface and the third surface extending from that second surface, said second cutting edges having second side cuts;

(f) wherein said first side cuts have a first radius of curvature and said second side cuts have a second radius of curvature;

(g) wherein said first radius of curvature on the first side of the waist section is smaller than said second radius of curvature on the first side of the waist section; and, (h) wherein said first radius of curvature on the second side of the waist section is smaller than said second radius of curvature on the second side of the waist section.

2. The snow ski according to claim 1 wherein the first radius of curvature on each side is between 35 and 50 feet and the second radius of curvature on each side is between 100 feet and 200 feet.

3. A downhill snow ski, one of an identical pair, having a shovel section separated from a heel section by a waist section extending along a longitudinal axis, on the top of which waist section boot bindings can be mounted, said waist section comprising:

(a) a bottom surface and a top surface;

(b) a first side and a second side;

(c) a first surface on each side extending vertically upward from the bottom surface, forming a first cutting edge along each intersection of said bottom surface and each first surface, said first cutting edges having first side cuts;

(d) a second surface on each side extending from the first surface on that side;

(e) a third surface on each side extending from the second surface on that side, forming a second cutting edge along each intersection of each second surface and the third surface extending from that second surface, said second cutting edges having second side cuts;

(f) wherein said first side cuts have a first radius of curvature and said second side cuts have a second radius of curvature;

(g) wherein said first radius of curvature on the first side of the waist section is smaller than said second radius of curvature on the first side of the waist section;

(h) wherein said first radius of curvature on the second side of the waist section is smaller than said second radius of curvature on the second side of the waist section; and (i) wherein the first radius of curvature on the first side of the waist section is smaller than the first radius of curvature on the second side of the waist section.

4. The snow ski according to claim 1 wherein each first surface forms a perpendicular intersection with the second surface extending from that first surface, and each second surface forms a perpendicular intersection with the third surface extending from that second surface.

5. The snow ski according to claim 1 wherein each second cutting edge is separated from a horizontal plane including the bottom surface by a predetermined distance, said predetermined distance being measured from each second cutting edge to said plane along a line perpendicular to the horizontal plane, said predetermined distance being equal to $(sc_1 - sc_2)$ Tan alpha wherein $sc_1$ is the first side cut of the first cutting edges, measured perpendicularly from a vertical plane tangent to the ski at the shovel and the heel, $sc_2$ is the second side cut of the second cutting edges, measured perpendicularly from a vertical plane tangent to the ski at the shovel and the heel, alpha is a constant angle formed by an edge line drawn tangent to the first edge and second edge, and a surface line drawn parallel to the bottom surface, said edge and surface lines being in a common vertical plane, said vertical plane being perpendicular to the longitudinal axis of the waist section.

* * * * *